United States Patent [19]

Nolf

[11] 4,222,734

[45] Sep. 16, 1980

[54] REMOTE LIGHTING DEVICE

[76] Inventor: Roland S. Nolf, R.D. #3, Box 240, Birdsboro, Pa. 19508

[21] Appl. No.: 947,208

[22] Filed: Sep. 29, 1978

[51] Int. Cl.[3] ..... F23Q 2/16; F23Q 21/00

[52] U.S. Cl. ..... 431/156; 431/277; 431/343; 431/344

[58] Field of Search ..... 431/253, 277, 156, 343, 431/344, 202, 345; 131/7, 185

[56] References Cited

U.S. PATENT DOCUMENTS

| | | | |
|---|---|---|---|
| 3,650,660 | 3/1972 | Huguet | 431/277 X |
| 4,013,398 | 3/1977 | Hendrix | 431/344 |

FOREIGN PATENT DOCUMENTS

| | | | |
|---|---|---|---|
| 1212462 | 3/1966 | Fed. Rep. of Germany | 431/277 |
| 2438912 | 2/1976 | Fed. Rep. of Germany | 431/156 |
| 446424 | 10/1912 | France | 431/277 |

*Primary Examiner*—Robert S. Ward, Jr.
*Attorney, Agent, or Firm*—Charles H. Lindrooth

[57] ABSTRACT

A lighting device for disposing a flame in hard-to-get-at or remote places is disclosed. As a source of combustible fluid, readily disposable-type cigarette lighters, having a fixed supply of gaseous fuel under pressure are utilized.

7 Claims, 3 Drawing Figures

REMOTE LIGHTING DEVICE

BACKGROUND OF THE INVENTION

Many times it is desirable to employ a hand-held device having an igniting or flame-bearing portion that is disposed at a distance from the hand of the user. Such devices are useful, for example, for lighting the pilots of gas-fired appliances that are found in camping vehicles and for lighting campfires.

One such known device employs a butane fuel source and a battery-powered glow plug disposed at a distance from the handle of the device for igniting the fuel. A disadvantage of these devices is that the batteries are often overlooked and expire after long periods of non-use and sometimes corrode, thereby rendering the device inoperative at a time when it is most needed.

Other devices known for the purpose employ a very long body section in which is mounted a disposable canister of butane or similar gas under pressure. The disadvantages of these devices are that they are costly and one must have a back-up supply of the specially designed fuel canisters; such canisters are usually not readily commerically available but are obtainable only from the manufacturer and are usually more costly than the readily available disposable lighters.

Another known device is shown in U.S. Pat. No. 4,013,398, this being essentially a holding device that holds a disposable-type lighter at a distance away from the hand of the user. This device has the disadvantage that it must be used with a type of lighter that remains in an "on" condition. Most of the inexpensive disposable-type lighters are in the normally "off" position and fuel will escape only when an actuating arm or lever is held by the user in an open position.

SUMMARY OF THE INVENTION

It is an object of this invention to provide a remote lighting device that utilizes a widely available and inexpensive source of fuel.

This and other objects of the invention are achieved by employing an elongate support member that has an outlet for the discharge of combustible fuel at one end thereof and a holding means or retainer at the other end thereof for receiving a disposable-type cigarette lighter. The support means carries a fuel inlet member that is designed to mate with the fuel supply nozzle of the lighter and a conduit for carrying fuel from the inlet to the fuel outlet.

DESCRIPTION OF THE PREFERRED EMBODIMENT

Figure 1:
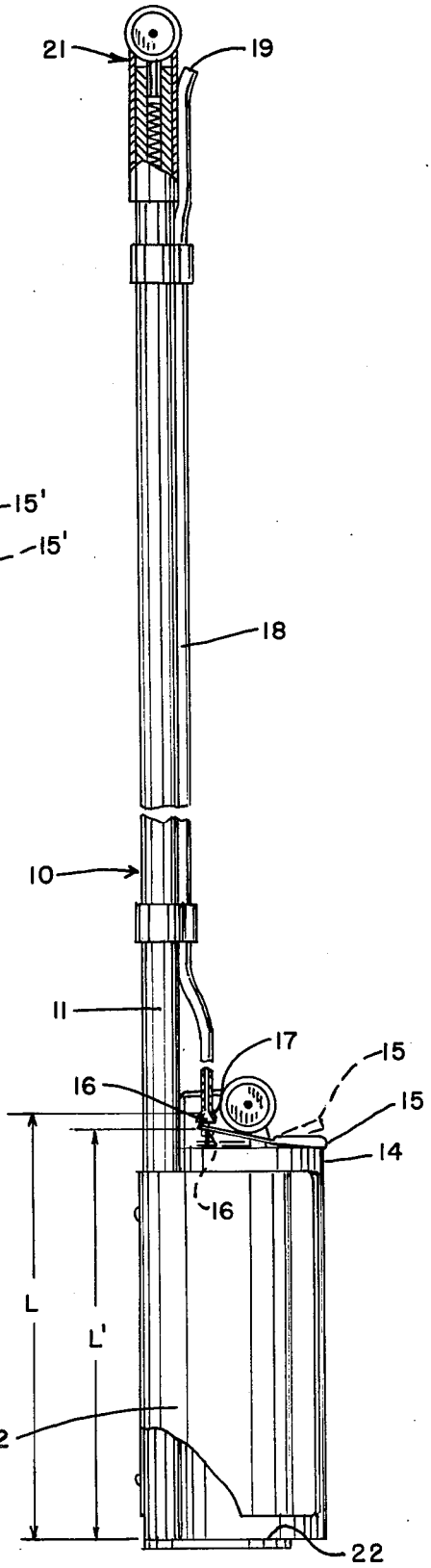
FIG. 1 is a side view of one form of apparatus according to the invention.

Referring to FIG. 1, the lighting device 10 comprises an elongate support member 11 that can be formed of substantially any strong, heat-resistant, relatively rigid material. The support member 11 has a base end at which a retaining means 12 is disposed. The retaining means 12 can be of many forms, but is preferably of a configuration such that it securely but easily releasably holds a disposable-type cigarette lighter. As shown, the releasing means 12 can be of a generally "U"-shaped configuration with the base of the "U" being somewhat flexible to releasably receive the disposable-type cigarette lighter 14.

Many types of disposable cigarette lighters are now widely available. One such lighter is currently sold under the mark BIC and another is sold in this country by the Gillette Company under the mark CRICKET. These lighters contain a fixed supply of a suitable fuel under pressure, for example, butane, and when the fuel is exhausted, the entire lighter is discarded and a new one obtained.

Figure 3:
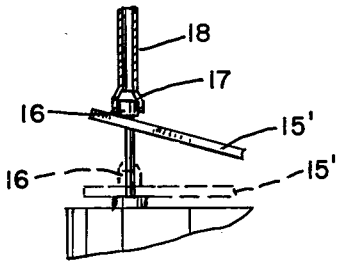
FIG. 3 is an enlarged view of the relationship of the nozzle and actuating lever of the lighter and the fluid inlet.

These designs have certain operating principles in common. Referring to FIG. 1, they employ a rocking actuating lever 15 that is shown in actuated position in the full line depiction of FIG. 1 and in the unactuated position in the dotted line depiction (see also FIG. 3). When the thumb-engaged portion of lever 15 is pressed down, the portion 15' rises from the body of the lighter and lifts a nozzle 16, at which time the pressurized fuel escapes from the nozzle and can be ignited by a conventional sparkwheel and flint. An elongated hole, narrower in transverse dimension than the diameter of the body of nozzle 16 is disposed in the portion of lever 15' beneath the nozzle body. The nozzle 16 is biased to the closed portion 16', and thus, when finger pressure is relieved from the lever, the nozzle returns to the closed position 16'. In the closed position, the nozzle is disposed a distance L' from the bottom of the body of the lighter and, when actuated, is disposed an extended distance L from the bottom of the body of the lighter. The distance between the two dimensions L and L' represents the distance that the nozzle is moved by the lever 15 to cause the fuel to flow from the nozzle, and in designs of which Applicant is aware, is usually between 1/6 and $\frac{1}{8}$".

The apparatus also includes a means for delivering a combustible gas under pressure from the base end of the member 11 to its distal end. In embodiment shown, this means comprises a conduit 18 that is affixed by suitable means, as by soldering, welding or clamping, to the member 11. Of course, it should be realized that the conduit 18 could also be formed integrally with the member 11. The conduit 18 includes an inlet 17 that is designed to engage the nozzle 16 in sealing relationship and an outlet orifice 19 disposed adjacent and distal end of the member 11.

Figure 2:
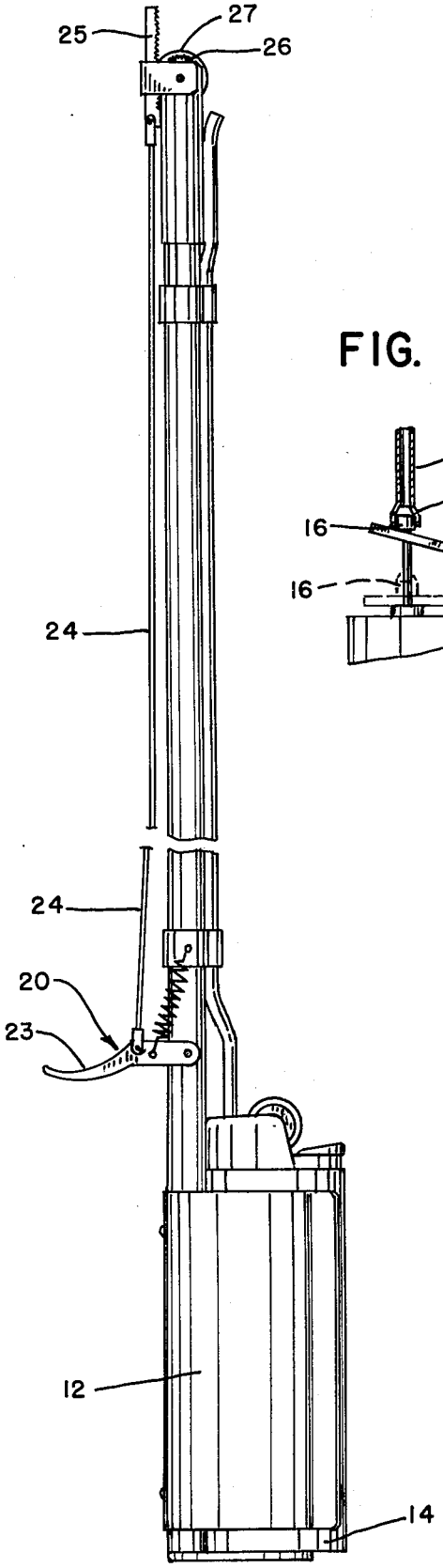
FIG. 2 is a side view of a lighter in accordance with the invention that employs manually actuable means adjacent the base end of the support for igniting fuel at the distal end of the support member.

Preferably, the distal end of the support member also includes means for igniting the combustible gas issuing from the orifice 19. This can comprise a conventional sparkwheel and flint arrangement. As shown in FIG. 2, it may be desirable to employ an actuating system 20 for rotating the sparkwheel to ignite the gas issuing from the orifice 19. Many such means for accomplishing this result can be incorporated in the device, the one shown in FIG. 2 employing a spring-loaded trigger 23 coupled via rod 24 with a rack gear 25 that engages a suitable spur gear 26 associated with the sparkwheel 27. The trigger is pulled by the user toward the base end of support 1, thereby imparting movement to the rack that in turn causes rotation of gear 26 and sparkwheel 27. It is contemplated that other remote actuation systems could be utilized to perform the same function.

In use, one positions the disposable lighter in the retaining means 12 with the nozzle 16 adjacent the inlet 17 to the conduit 18. When the actuating lever 15 is pressed down, the nozzle 16 is lifted into sealing relationship with the inlet 17 that is suitably sized and configured to receive the nozzle in sealing relationship. In the known types of widely available disposable lighters, the lever 15 can be actuated without moving the spark-wheel that is a part of the lighter. Thus, premature ignition of the combustible gas from the lighter issuing from the nozzle 16 is avoided.

Combustible gas from a source within the lighter 14 passes through the interior of the nozzle 16 and into the conduit 18 and is carried thereby to the discharge orifice 19, at which point the gas can be ignited.

It is desirable to position the conduit inlet 17 with respect to the reaction surface 22 of the retaining means so that the distance between them is equal to or slightly less than the maximum extended distance L of the nozzle. This is desirable so that by merely pressing the lever 15, a positive, longitudinally-directed locking force can be applied to the bottom of the lighter 14 by surface 22; this ensures that the nozzle 16 will remain in the inlet portion 17 so long as the lever 15 is held in the actuated position. However, when the lever 15 is in relaxed condition (dotted line position of FIGS. 1 and 3), the distance between the inlet 17 and reaction surface 22 is such that the nozzle is disposed a sufficient distance from the inlet so that the lighter can be removed. Alternatively, a compressible, resilient member such as a compression or leaf spring or a strip of elastomeric foam material could be positioned between the bottom of lighter 14 and surface 22 for developing the desired longitudinal force for ensuring a sealing engagement of the nozzle 16 with inlet 17.

The lighting device disclosed takes inherent advantage of the feature of flame height adjustment that is present in many of the disposable-type lighters that are available. This feature involves the adjustability of the gas flow rate from the nozzle 16, which is normally accomplished by means of a cam wheel that can be turned by the user for readily adjusting the length of the flame in accordance with wind conditions or the particular use to which the lighter is being put. By adjusting the gas flow rate of the lighter, the length of the flame issuing from the orifice 19 can be controlled so that a very long, almost torch-like, flame can be produced, or a very small pilot-type flame can be produced. No structural modifications to Applicant's device are necessary to accomplish this result. One merely removes the lighter and adjusts the gas flow regulating means of the disposable lighter and reinserts it into the device to obtain the desired flame size.

I claim:

1. A lighting apparatus comprising:

an elongate support member having a base end and a distal end;

a fluid conduit extending from adjacent the base end of the support member to near the distal end and having a fluid inlet at the end adjacent the base end of the support member and a fluid outlet disposed adjacent the distal end of the support member;

retaining means at the base end of the support member for releasably retaining a disposable lighter of the pressurized fuel type having a nozzle movable to an open position;

the fluid inlet of the conduit being configured to receive the movable nozzle of the lighter.

2. Apparatus as in claim 1 and further comprising means for imparting a sealing force to ensure sealing engagement of the nozzle with the fluid inlet.

3. Apparatus as in claim 1 wherein the fluid inlet is positioned to receive the movable nozzle in the open position.

4. Apparatus as in claim 1 wherein the retaining means includes a reaction surface and wherein the distance between the reaction surface and the fluid inlet to the conduit corresponds to the extended distance of the nozzle from the bottom surface of the lighter.

5. Apparatus as in claim 1 and further comprising means at the distal end of the support for igniting combustible fluid issuing from the outlet of the conduit.

6. Apparatus as in claim 5 and further comprising means adjacent the retaining means for actuating the igniting means.

7. A lighting apparatus comprising:

an elongate support member having a base end and a distal end;

a fluid conduit extending from adjacent the base end of the support member to near the distal end and have a fluid inlet at the end adjacent the base end of the support member and a fluid outlet disposed adjacent the distal end of the support member;

retaining means at the base end of the support member for releasably retaining a lighter of the pressurized fuel type having nozzle;

the fluid inlet of the conduit being configured to receive the nozzle of the lighter.

* * * * *